US006981768B2

(12) United States Patent
Saksa et al.

(10) Patent No.: US 6,981,768 B2
(45) Date of Patent: Jan. 3, 2006

(54) HAND HELD INKJET PEN

(75) Inventors: Thomas A. Saksa, Albany, OR (US); Grant K. Garner, Corvallis, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 343 days.

(21) Appl. No.: 10/283,949

(22) Filed: Oct. 30, 2002

(65) Prior Publication Data

US 2004/0085430 A1 May 6, 2004

(51) Int. Cl.
*B41J 3/36* (2006.01)

(52) U.S. Cl. ..... 347/109

(58) Field of Classification Search ..... 347/9–11, 347/108, 109; 400/88; 401/46, 195
See application file for complete search history.

(56) References Cited

U.S. PATENT DOCUMENTS 4,412,232 A * 10/1983 Weber et al. ..... 347/68
4,748,460 A * 5/1988 Piatt et al. ..... 347/109
6,312,124 B1 11/2001 Desormeaux
6,749,355 B2 * 6/2004 Payne et al. ..... 401/195

* cited by examiner

*Primary Examiner*—Manish S. Shah
*Assistant Examiner*—An H. Do

(57) ABSTRACT

A hand held inkjet pen includes a housing, an ink reservoir, an inkjet printhead and a spacer. The ink reservoir is located within the housing. The inkjet printhead is located toward a distal end of the housing, and includes a plurality of nozzles for ejecting ink received from the reservoir. The spacer is located at the distal end of the housing for contacting a media sheet. Force applied to the spacer selects an on state for controlling ejection of ink from the plurality of nozzles.

41 Claims, 4 Drawing Sheets

FIG.1
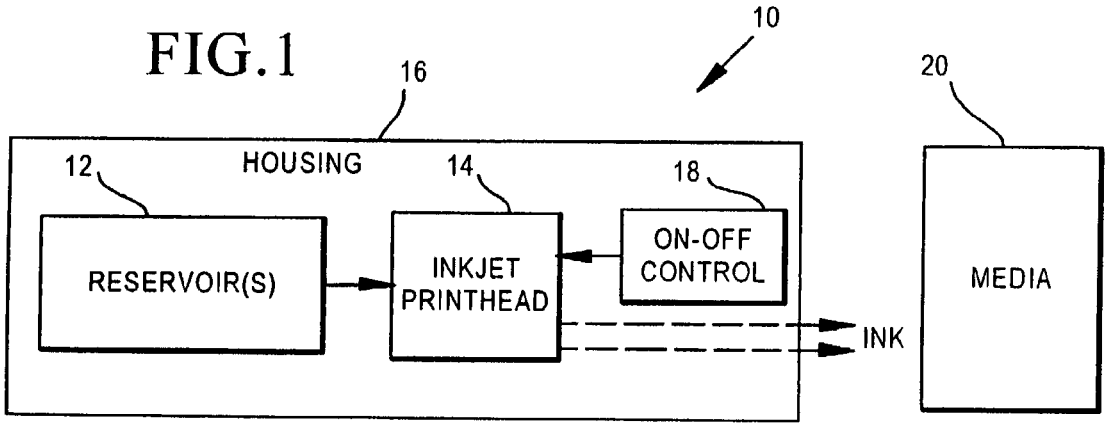
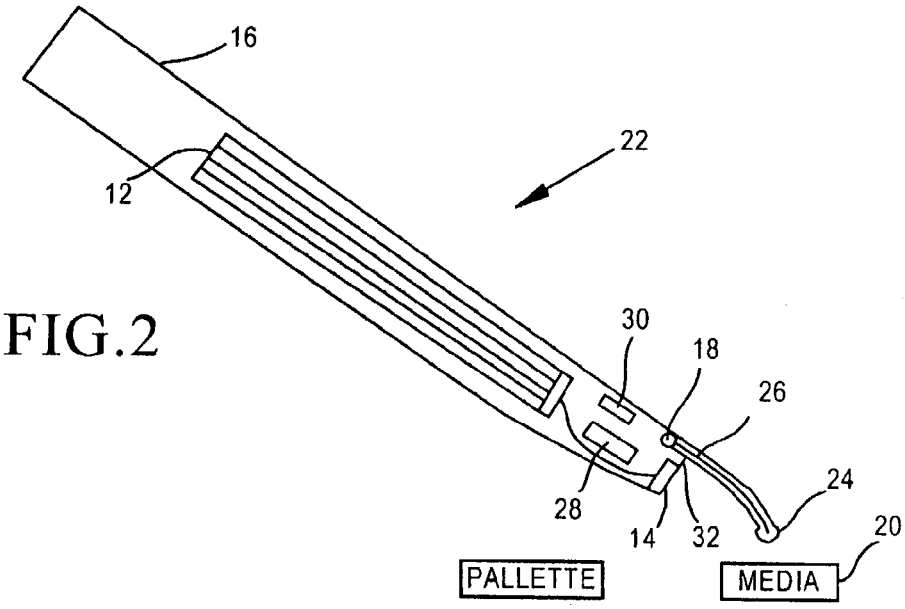
FIG.2
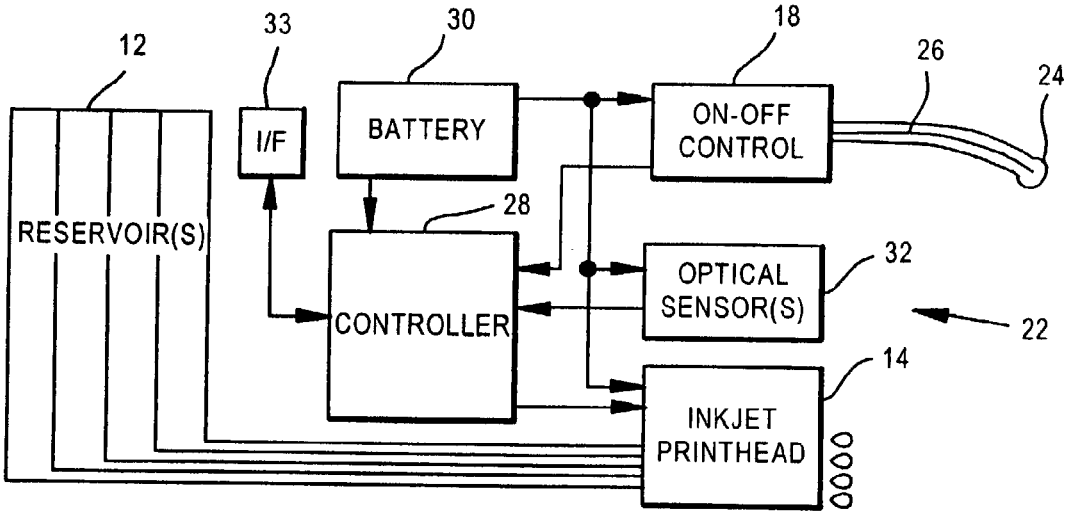
FIG.3

HAND HELD INKJET PEN

BACKGROUND

An inkjet print recording system is a type of non-impact printing device which forms characters, symbols, graphics or other images by controllably spraying drops of ink. The inkjet system typically includes a cartridge which houses a printhead. The printhead has very small nozzles through which ink drops are ejected. To print an image the pen typically is propelled back and forth across a media sheet, while the ink drops are ejected from the printhead in a controlled pattern.

Inkjet print recording systems can be used in a variety of devices, such as printers, plotters, scanners, facsimile machines, copiers, and the like. There are various forms of inkjet printheads, including, for example, thermal inkjet printheads and piezoelectric printheads. In a thermal inkjet printing system, ink flows along ink channels from a reservoir into an array of vaporization chambers. Associated with each chamber is a heating element and a nozzle. A respective heating element is energized to heat ink contained within the corresponding chamber. The corresponding nozzle forms an ejection outlet for the heated ink. As the pen moves across the media sheet, the heating elements are selectively energized by a controller, which causes ink drops to be expelled in a controlled pattern. The ink drops dry on the media sheet shortly after deposition to form a desired image (e.g., text, chart, graphic or other image).

Some of the technologies for delivering ink to paper with a hand held pen, include ball point pen technology, felt tip pen technology, fountain pen technology, and quill pen technology. Each of these pen types are different with regard to ease of use, cost, print quality, and impacts on the writer. Different visual effects are sometimes observed for the different pen types. Also, different pressing forces are required of the pen holder when applying ink to the paper.

SUMMARY OF THE INVENTION

A hand held inkjet pen includes a housing, an ink reservoir, an inkjet printhead and a spacer. The ink reservoir is located within the housing. The inkjet printhead is located toward a distal end of the housing, and includes a plurality of nozzles for ejecting ink received from the reservoir. The spacer is located at the distal end of the housing for contacting a media sheet. Force applied to the spacer selects an on state for controlling ejection of ink from the plurality of nozzles.

BRIEF DESCRIPTION OF THE DRAWINGS

FIG. 1 is a block diagram of a hand-held inkjet pen according to an embodiment of the invention;

FIG. 2 is a perspective view of a hand-held inkjet pen according to another embodiment of the invention;

FIG. 3 is a block diagram of the inkjet pen of FIG. 2;

DETAILED DESCRIPTION OF A PREFERRED EMBODIMENT

Figure 4:
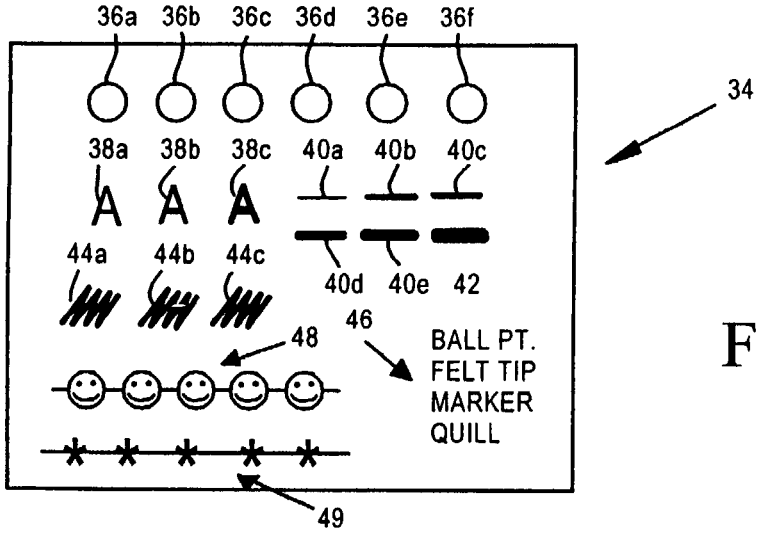
FIG. 4 is a diagram of a functional option palette for use with a hand-held inkjet pen.

Referring to FIG. 1, a hand-held inkjet pen 10 includes one or more ink reservoirs 12 and an inkjet printhead 14 packaged within a housing 16. The inkjet pen 10 is a stand-alone device providing ink output under the control of an operator holding the pen 10. An on-off control 18 is linked to the printhead 14 to define an on state and an off state for ink output. Typically, an operator positions the pen over a writing surface to direct ink output onto a media 20. In one embodiment the pen 10 includes a single reservoir storing ink of a given color. The operator controls the on-off control 18 to determine whether the pen 10 is in the on state or the off state. In the on state, ink is ejected from nozzles in the inkjet printhead. In the off state, ink is not output.

The printhead 14 includes a plurality of inkjet nozzles. Each nozzle includes an inkjet chamber with a firing resistor and an outlet orifice. Ink is received into each chamber from the reservoir 12. The firing resistor is activated to eject a droplet of ink through the outlet orifice.

Referring to FIGS. 2 and 3, a hand-held inkjet pen 22 embodiment is illustrated in which like parts are given like numbers to the inkjet pen 10. The inkjet pen 22 is packaged in a pen or marker sized container. In particular, the pen 22 has a housing 16 which is elongated and generally slender for hand holding comfort. The operator grasps the pen as would one implementing a conventional ball point pen, fountain pen, felt-tip pen or the like. Packaged within the housing 16 are one or more ink reservoirs 12 and electronics circuitry. At a distal end of the housing 16 is the inkjet printhead 14. It is desirable to space the printhead from a writing surface to avoid damaging the printhead or clogging the orifices as might occur if the printhead contacted the writing surface. A spacer 24 is located at a distal end of the pen 22 to space the printhead from the writing surface. The spacer 24 fixes the distance between the printhead and the media for a given pen orientation. While writing, the spacer is the portion of the pen making contact with the media 20. The spacer provides tactile feedback to the operator as the operator moves the pen along the media.

In addition, the spacer is coupled to the on-off control 18. In one embodiment the on-off control 18 is formed by a strain gauge 26. The strain gauge 26 defines an on state when a prescribed amount of pressure is applied at the spacer 24. Such pressure is applied as the operator holding the pen presses the spacer to the media 20. When the prescribed pressure is applied, the pen 22 ejects ink onto the media 20. When the pressure is removed or becomes less than the prescribed pressure, the strain gauge 26 returns to the off state causing ink output to cease.

The pen 22 also includes a controller 28 and a power source 30. The power source may, for example, be a battery packaged in the housing 16 and accessible for replacement as the battery life diminishes. The controller 28 is coupled to the on-off control 18/strain gauge 26 and the inkjet printhead 14. While the on-off control 18 defines the on state the controller 28 keeps the printhead 14 active so as to eject ink. While the on-off control 18 defines the off state, controller keeps the printhead inactive so as not to eject ink.

In some embodiments the pen also includes an optical sensor 32. The sensor 32 is positioned to sense in the vicinity of the pen's output field (e.g., in the vicinity of the pen tip, the pen spacer and the pen printhead. In one embodiment the sensor 32 serves as an input device for allowing an operator to select specific functional features of the pen. For example, in a pen having the capability to print varying colors, the sensor 22 scans a colored surface and sets the pen color to such surface's color. The colored surface can be scanned from a palette accompanying the pen or can be scanned from a random surface selected by the operator. In this manner, the sensor provides the pen with a learning capability.

The random surface can be sampled from any object in the user environment. In one application, the pen is used as a touch-up device. The pen senses the desired surface to be programmed to the surface's color. The pen then is used to apply ink at blemishes elsewhere on the surface to touch-up the surface with matching color. Alternatively, the sampled color is saved and later output for color sampling or reproduction by another device. For example, the pen can reproduce the color by outputting ink or can link to another device to output a signal which specifies or otherwise identifies the previously sensed color. In one embodiment, the sampled color is downloaded in a digital or analog encoded signal through an interface 33 to a device which produces color-matched paint, cloth, or other color media. The interface 33 in various embodiments is an electrical interface, an infrared interface, or an optical interface. In other embodiments the interface 33 is omitted, and the color is reproduced in ink output from the printhead 14.

FIG. 4 shows a palette 34 which defines several functional options for the pen 22. The operator scans the desired option to select the pen output. For example, the operator may scan one of a group of colors 36*a*–36*f*. The number of color options may vary according to the embodiment. As another example, the operator can select character boldness among a range of boldness values 38*a*–*c*. The number of boldness values may vary according to the embodiment. As still another example, the operator can select among various line widths 40*a*–40*e*, where the number of line width selections may vary according to the embodiment. In another example, the operator can select among a number of ink output textures 44*a*–44*c*, where the number of selections may vary according to the embodiment. The operator can select to output a rainbow of colors 42. The operator can select among a set of tip styles 46, such as a ball point pen tip style, a felt tip pen tip style, a marker tip style. Various tip styles can be defined, even a quill pen tip if desired. Still another option that an operator may select in some embodiments is a superimposed pattern to the ink output. Various patterns can be implemented according to the embodiment. For illustration purposes two patterns are depicted. One pattern is a superimposed pattern of smiley faces 48. Another pattern is a superimposed pattern of stars 49.

Figure 5:
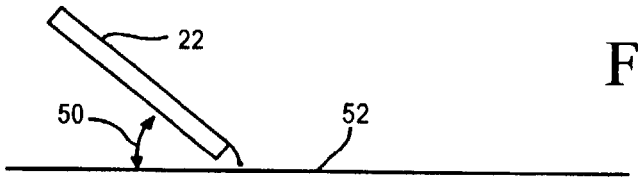
FIG. 5 is a diagram of a pen at an angle relative to a writing surface.

In an alternative embodiment the output sensor 32 is implemented with the controller 28 to detect pen 22 angle 50 relative to the writing surface 52, as shown in FIG. 5. The sensor samples the media surface 52 at a specific frequency (e.g., thousands of times per second) and processes the samples to determine the pen angle. Based on the detected pen angle, the controller 28 adjusts the firing sequence of the printhead nozzles to correct for pen angle. Such correction is beneficial for providing desired line widths, ink texture, superimposed patterns or other ink output function.

Figure 6:
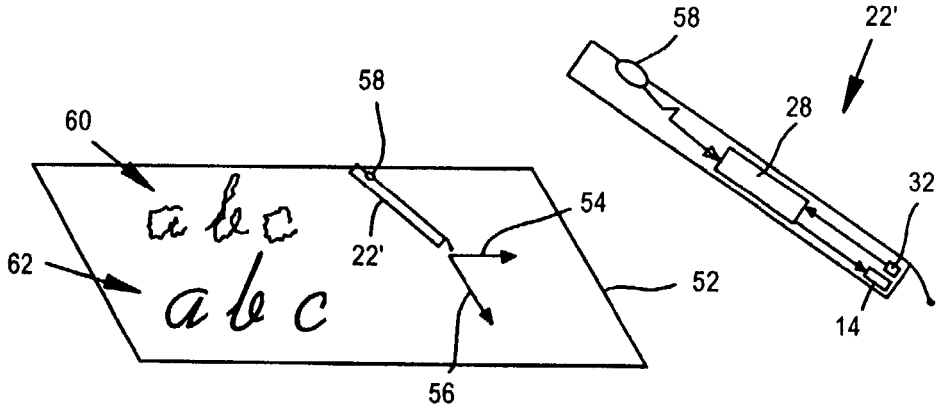
FIG. 6 is a diagram of a hand-held inkjet pen and writing surface.
Figure 7:
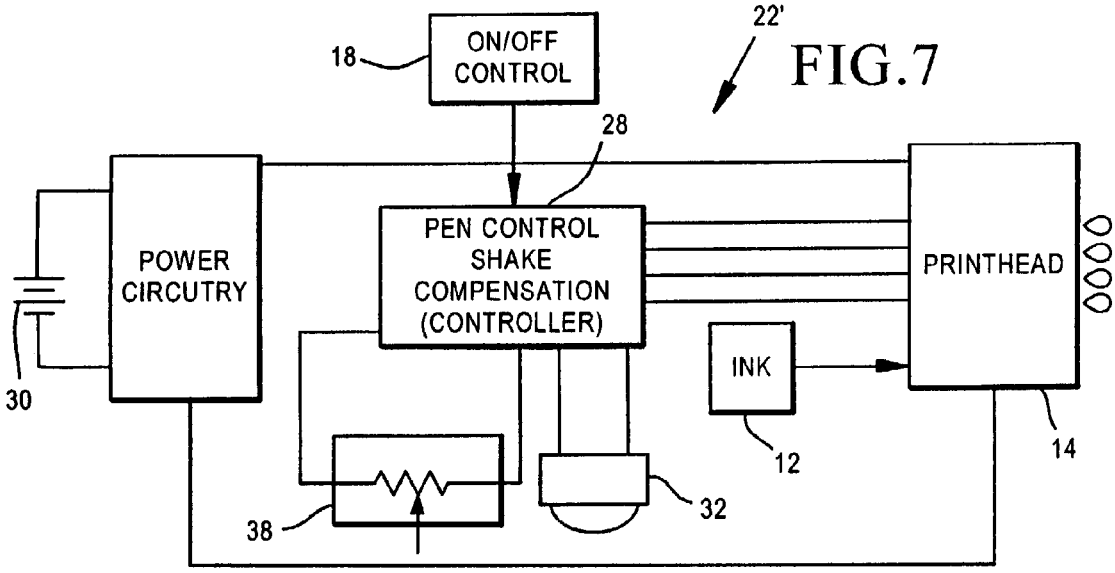
FIG. 7 is a block diagram of a hand-held inkjet pen according to another embodiment of the invention.

In another embodiment pen 22' further includes a compensation adjustment input 58. In such embodiment the sensor 32 is used for tracking the pen 22 relative to the writing surface 52. Motion is tracked along various axes 54, 56. The compensation adjustment input allows the operator to adjust pen output to compensate for a trembling hand (e.g., pen shaking). For example, an operator with a trembling hand will direct a conventional pen to produce jagged lines. Referring to FIGS. 6 and 7, a trembling hand may produce jagged letters 60. An operator can turn on compensation control to compensate for the trembling or shaking hand. In some embodiments the input 58 is adjustable to determine the sensitivity for detecting trembling and shaking. In other embodiments, the input 58 is simply an on-off input for selecting compensation or not. FIG. 7 shows the sensitivity adjustment device as a potentiometer, although other input control mechanisms may be implemented instead.

As the pen motion is tracked by the sensor 32, the selected sensitivity is used by control processing to determine what motion variation is considered to be undesired pen shaking as opposed to desired pen direction change. In some embodiments, the sensor 32 may be an accelerometer which measures the instantaneous acceleration of the pen. This signal is processed to track pen displacement of the pen spacer 24 over time. The displacement information is filtered to distinguish between low frequency changes in displacement (e.g., taken to be the intended motion of the pen) and the higher frequency changes in displacement occurring within the slower frequency changes (e.g., the shaking occurring while moving the pen). The threshold for distinguishing between low frequency displacements and high frequency displacements may be varied using the sensitivity adjustment device. The sensitivity control device selects or adjusts one or more compensation control filters (not shown). In some embodiments changes in pen acceleration are detected. Acceleration changes exceeding a threshold change correspond to shaking. High frequency shaking is filtered out contributing to a natural writing experience. The inkjet printhead nozzle firing pattern is adjusted by the control processing based on the filter output and the sensitivity adjustment so that, in effect, all or a portion of the shaking motion is filtered out. The result is an improvement in the writing quality, specifically an improved smoothness to the lines and lettering 62.

Figure 8:
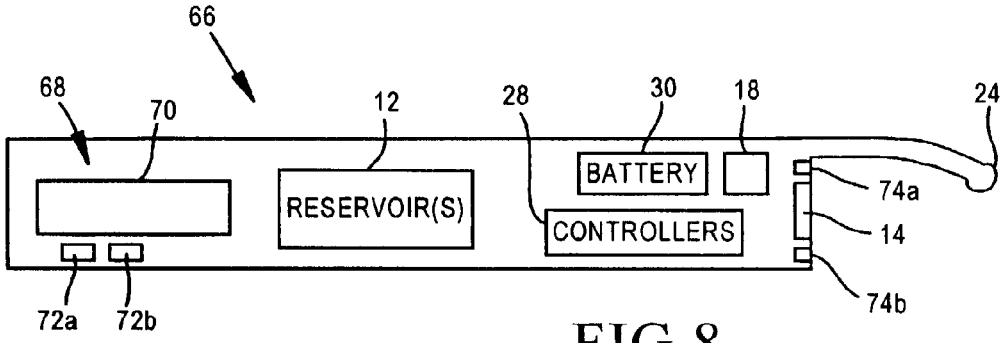
FIG. 8 is a perspective view of another hand-held inkjet pen.

Referring to FIG. 8 in another embodiment a hand-held pen 66 includes a user interface 68. Like parts are given like functions relative to the pens 10, 22 and 22'. The hand-held pen 66 also may include an optical sensor (not shown in FIG. 8) in some embodiments. Such sensor performs as described above for the other pen embodiments (e.g., sense pen angle, track pen motion). In some embodiments the shaking compensation and sensitivity input also may be included.

The user interface 68 may vary according to the embodiment. In an exemplary embodiment the user interface includes a one-line LCD 70 and one or more buttons 72*a*, 72*b*. In some embodiments the input buttons may be integral to the LCD, as in a touch-sensitive LCD. The operator uses the buttons to display and select pen functional options. Such options include those described above. By way of example, various ink output styles may be selected, such as: ink color, line thickness, ink boldness, ink texture. In some embodiments, a superimposed output pattern may be selected. Examples were previously described with regard to FIG. 4, and may vary. In some embodiments a pen tip style may be simulated, such as ball point, felt tip, marker, calligraphy or other tip style. The ink output features are defined for the various tip styles. In some embodiments the tip style also determines the required pressure to be applied at the spacer 24 to place the pen in the on state.

Figure 9:
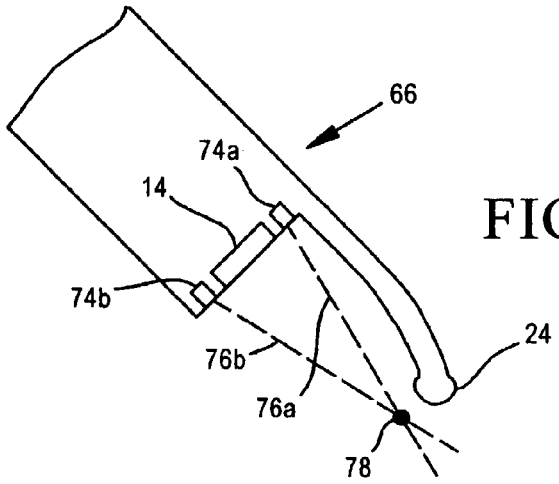
FIG. 9 is a partial view of a pen distal portion for a pen having light beam output for illuminating an ink target location.

Referring to FIGS. 8 and 9, in some embodiments the hand-held inkjet pen also includes one or more projected beams of light to illuminate where ink is to be delivered. For example, one or more light emitting diodes or laser diodes 74*a*, 74*b* output a respective beam 76 directed toward a writing surface. In an embodiment including multiple beams 76*a*, 76*b*, the beams intersect at a point 78 which identifies where ink is to be delivered by the printhead 14. In an embodiment including only one beam, the beam is directed long a path of ink output to approximate where ink is to be delivered. Although the spacer 24 is shown in the embodiments including the output light beams, in alternative embodiments the spacer 24 is omitted. Further, although the light beams are illustrated for pen 66, the light source(s) 74 also may be included in the pen embodiments 10, 22 and 22'.

Figure 10:
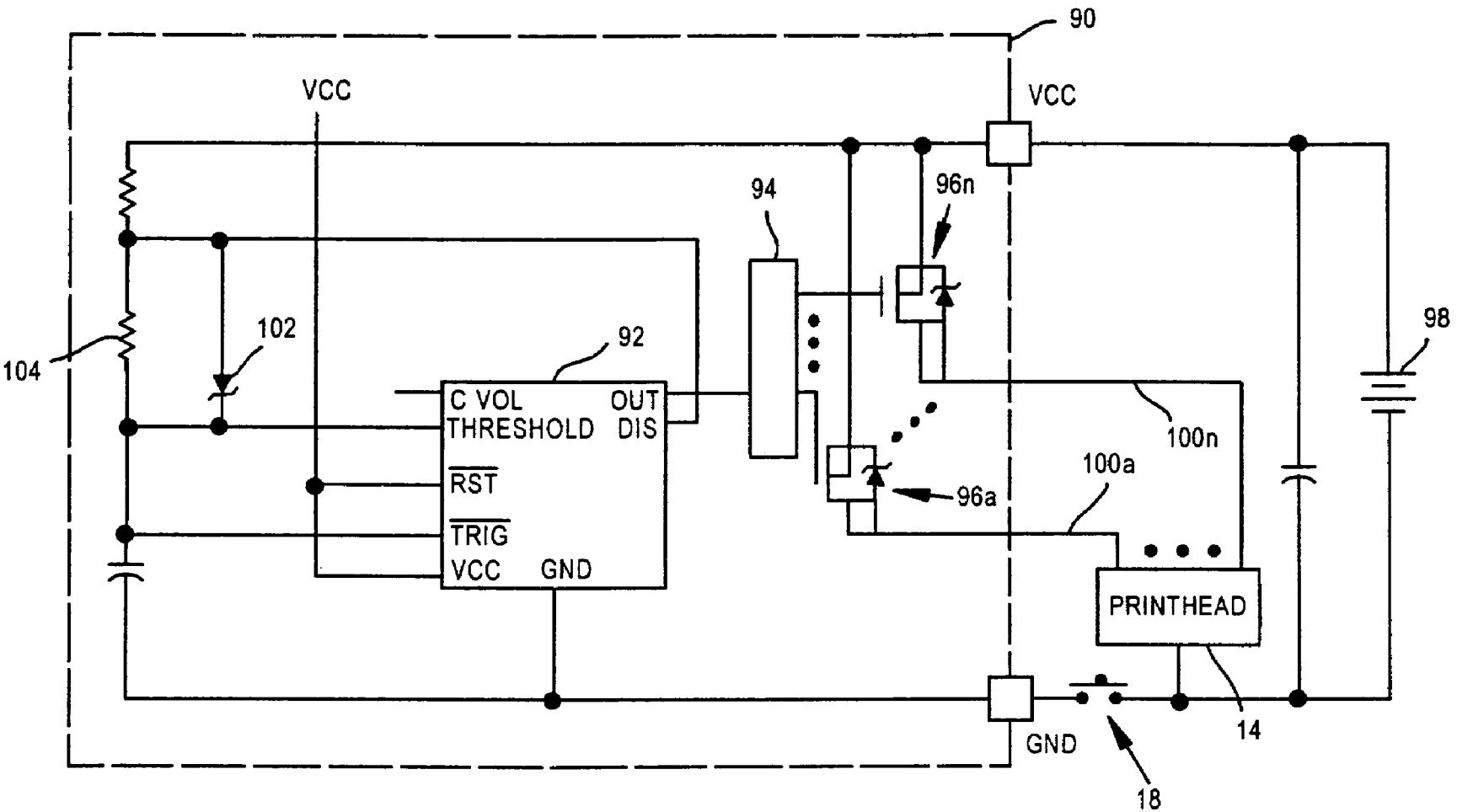
FIG. 10 is a schematic diagram of an electrical circuit for one embodiment of a controller for a hand-held inkjet pen.

In various embodiments the controller 28 may be formed using an integrated circuit microcontroller. Alternatively, a controller embodiment may be formed using an electrical circuit 90, including an oscillator 92, a sequencer 94 and a plurality of firing transistors 96. Referring to FIG. 10, the circuit 90 receives a power signal from a power source 98. The oscillator 92 is configured as a multivibrator circuit. When the on-off control 18 is in the on state the circuit 90 outputs a sequence of firing signals 100*a–n* to the printhead 14. In particular the oscillator 92 drives a shift register 94 which sequences the firing of transistors 96*a*–96*n*. Each firing resistor 96 is coupled to a printhead nozzle to control firing of the corresponding nozzle. Each of the firing signals 100*a–n* has a predetermined frequency for driving output of the corresponding nozzle.

To improve consistency among ink drops output from each nozzle, it is desirable that the drive signal triggering a nozzle have substantially the same amount of energy as the drive signal for the other nozzles. More specifically, it is desirable that the active pulse of a given firing signal 100*a–n* delivers substantially the same amount of energy to its corresponding nozzle firing resistor as the active pulse of any other firing signal 100*a–n*. Further, an active pulse of a given firing signal 100*a–n* delivers substantially the same amount of energy to its corresponding nozzle firing resistor as any prior or later active pulse of the same firing signal 100. The amount of energy may be set for a given pen architecture.

One manner of improving consistency among each active pulse of each firing signal 100 is to generate a substantially constant pulse width and a substantially constant pulse voltage level for each such active pulse. When implementing a battery-powered pen, there is a challenge in achieving such goal because the battery's output voltage typically drops as the battery life progresses. In one embodiment a voltage regulator is used to maintain the uniformity among active pulses of each firing signal over the life of the battery. To avoid the added cost and complexity of including a voltage regulator, a non-linear device may be implemented in an alternative embodiment.

Referring again to FIG. 10, a zener diode 102 is placed in parallel with a discharge resistor 104 of the multivibrator circuit. The resistor 104, as configured with the zener ediode 102, causes the multivibrator circuit to discharge more rapidly at higher voltages, while have less or no effect on pulse width at lower voltages. When the battery 98 is fully charged, the active pulse voltage of firing signal 100*a–n* is relatively high, while the pusle width is relatively shortened. As the battery life progresses, the active pulse voltage declines, while the pulse width increases. More specifically, the active pulse's voltage is relatively lower, while the pulse width is relatively longer compared to the voltage and width of a pulse generated by a more charged battery. The zener diode 102 functions to at least partially counteract the declining output voltage of the battery, so that the multivibrator circuit generates firing signals having an approximately constant energy pulse over a range of battery voltages. This allows nozzle firing to occur relatively reliably over the life of the battery in the presence of changes in the delivered output voltage. As a result, the pen functions for a longer time. For example, in an embodiment using a 12 volt battery, the pen operates down to a battery voltage of approximately 8 volts. A similar circuit without the adjustment introduced by the zener diode 102 would not work as well once the battery voltage dipped below approximately 11 volts. Replacing the battery at the 11 volt output level would result in wasting more than half of the battery energy, otherwise available to the pen.

While the above is discussed in terms of preferred and alternative embodiments, the invention is not intended to be so limited.

What is claimed is:

1. A hand held inkjet pen, comprising:

a housing;

an ink reservoir located within the housing;

an inkjet printhead located toward a distal end of the housing, wherein the inkjet printhead comprises a plurality of nozzles for ejecting ink received from the reservoir; and a spacer including a strain gauge at the distal end of the housing for contacting a media sheet, wherein force applied to the spacer selects an on state for controlling ejection of ink from the plurality of nozzles.

2. A hand held pen according to claim 1, in which the spacer provides tactile feedback to the operator as the operator moves the pen along the media.

3. A hand held inkjet pen according to claim 1, which is a stand-alone wireless pen further comprising a power source.

4. A hand held inkjet pen according to claim 3, further comprising:

a plurality of drive signals having a predetermined frequency for driving the plurality of nozzles, wherein an active portion of the plurality of drive signals substantially delivers a prescribed amount of energy to the plurality of nozzles; and means for adjusting pulse width of said active portion in relation to a voltage delivered from the power source to substantially maintain the prescribed amount of energy of said active portion as the voltage delivered from the power source declines.

5. A hand held inkjet pen according to claim 1, further comprising a controller for supplying signals to eject the ink from the printhead during an on state.

6. A hand held inkjet pen according to claim 5, in which the controller comprises an oscillator and a plurality of drive transistors corresponding to the plurality of nozzles, with the oscillator configured to establish a frequency at which the plurality of drive transistors are switched.

7. A hand held inkjet pen according to claim 6, further comprising an optical sensor coupled to the controller.

8. A hand held inkjet pen according to claim 7, in which the optical sensor includes a configuration to provide output related to a color of a surface.

9. A hand held pen according to claim 8, further comprising an interface configured to output a signal specifying the color.

10. A hand held inkjet pen according to claim 7, in combination with a separate palette, wherein the optical sensor scans a portion of the palette to select a pen functional option.

11. A hand held inkjet pen according to claim 1, further comprising a means for receiving an operator selection of a pen functional option.

12. A hand held inkjet pen according to claim 11, wherein the pen functional option is from a group of output styles, including: ink color, ink boldness, line width and ink texture.

13. A hand held inkjet pen according to claim 11, wherein the pen functional option is a superimposed pattern to the ink output.

14. A hand held inkjet pen according to claim 11, wherein the pen functional option is a rainbow of ink colors.

15. A hand held inkjet pen according to claim 11, wherein the pen functional option is a simulated pen tip style.

16. A hand held inkjet pen according to claim 1, further comprising an optical sensor which senses pen angle relative to the media; and a controller which controls nozzle firing to define an appropriate firing pattern for the sensed pen angle.

17. A hand held inkjet pen according to claim 1, further comprising an optical sensor to track motion of the pen along a media; and a controller to control firing the plurality of nozzles to compensate for operator shaking of the pen.

18. A hand held inkjet pen according to claim 17, further comprising a sensitivity control for detecting shaking.

19. A hand held inkjet pen according to claim 1, further comprising a light source for illuminating a target location to receive ink.

20. A hand held inkjet pen, comprising:

a housing;

an ink reservoir located within the housing;

an inkjet printhead located toward a distal end of the housing, wherein the inkjet printhead comprises a plurality of nozzles for ejecting ink received from the reservoir;

an on-off control coupled to a strain gauge resident to the pen to control ejection of the ink and having an on state and an off state as selected by an operator holding the pen;

an optical sensor on the pen; and a controller to control firing of the plurality of nozzles based on the sensed media while the on-off control is in the on state.

21. A hand held inkjet pen according to claim 20, in which the optical sensor includes a configuration to sense pen angle relative to the media, and with the controller configuration to sense pen angle relative to the media, and with the controller configured to define an appropriate firing pattern for the pen angle.

22. A hand held inkjet pen according to claim 20, in which the optical sensor includes a configuration to track motion of the pen along a media, with the controller to control firing of the plurality of nozzles to compensate for operator shaking of the pen.

23. A hand held inkjet pen according to claim 22, further comprising a sensitivity control for detecting pen shaking.

24. A hand held inkjet pen according to claim 20, further comprising:

a spacer at the distal end of the housing for spacing the inkjet printhead from a media surface, with the spacer for providing tactile feedback to the operator as the operator moves the pen along the media, the spacer being coupled to the on-off control wherein applied pressure to the spacer selects an on state for controlling ink ejection from the plurality of nozzles.

25. A hand held inkjet pen according to claim 20, in combination with a separate palette, wherein the optical sensor scans a portion of the palette to select a functional option for controlling ink output.

26. A method of writing with an inkjet pen, the inkjet pen including a housing, an ink reservoir located within the housing, a printhead located toward the distal end of the housing, an on-off control resident to the inkjet pen, and a spacer including a strain gauge at the distal end for activating the on-off control, the method comprising:

positioning the inkjet pen over a medium with the spacer spacing the printhead from the medium;

applying pressure to the medium with the spacer including a strain gauge to select an on state;

while in the on state ejecting ink from a plurality of nozzles; and selecting an off state of the inkjet pen to terminate ejection of the ink.

27. A method according to claim 26, further comprising:

scanning in a functional option of the inkjet pen, the functional option from the group of functional options including ink color, line width, and line boldness.

28. A method according to claim 26, further comprising:

selecting a functional option of the pen, the functional option from the group of functional options including ink color, line width, and line boldness.

29. A method according to claim 26, further comprising:

selecting a functional option of the inkjet pen, the functional option comprising an output style.

30. A method according to claim 26, further comprising:

selecting a functional option of the inkjet pen, the functional option comprising a superimposed pattern onto the medium.

31. A method according to claim 26, further comprising:

selecting a functional option of the inkjet pen, the functional option comprising a simulated pen tip style.

32. A method according to claim 26, further comprising:

generating a trigger signal for each of the plurality of nozzles, the trigger signal having an active state at a predetermined output frequency for a prescribed pulse width; and substantially maintaining the pulse width in the presence of a changing power supply signal.

33. A method according to claim 26, further comprising:

sensing an inkjet pen angle relative to the medium; and determining an appropriate nozzle firing pattern for the inkjet pen angle.

34. A method according to claim 26, further comprising:

tracking motion of the inkjet pen along the medium; and controlling nozzle firing to compensate for operator shaking of the inkjet pen.

35. A method according to claim 34, further comprising:

adjusting a sensitivity control for tracking shaking of the inkjet pen.

36. A method of writing with a pen, the pen including a housing, an ink reservoir located within the housing, a printhead located toward a distal end of the housing, an on-off control coupled to a strain gauge resident to the pen, and a spacer at the distal end, the method comprising:

positioning the pen over a medium with the spacer spacing the printhead from the medium;

selecting an on state of the pen;

while in the on state ejecting ink from a plurality of nozzles at a predetermined output frequency; and selecting an off state of the pen to terminate ejection of the ink.

37. A method according to claim 36, further comprising:

sensing a pen angle relative to the medium; and defining an appropriate firing.

38. A method according to claim 36, further comprising:

tracking motion of the pen along the medium; and controlling firing of the plurality of nozzles to at least partially compensate for shaking of the pen.

39. A hand held inkjet pen, comprising:

means for housing ink;

means for ejecting ink from a plurality of nozzles; and means including a strain gauge for contacting a media surface, wherein force applied to the means for contacting selects an on state of the means for ejection.

40. A hand held inkjet pen according to claim 39, further comprising:

means for sensing inkjet pen angle relative to the media surface; and means for controlling the means for ejecting to define an appropriate nozzle firing pattern for the sensed inkjet pen angle.

41. A hand held inkjet pen according to claim 39, further comprising:

means for sensing motion of the inkjet pen along the media surface; and means for controlling the means for ejecting to compensate for operator shaking of the inkjet pen.

* * * * *